US008424464B2

(12) United States Patent
Korpi

(10) Patent No.: US 8,424,464 B2
(45) Date of Patent: Apr. 23, 2013

(54) PORTABLE, COLLAPSIBLE, WORKSTATION TRAY TABLE APPARATUS

(76) Inventor: Norman Korpi, West Hollywood, CA (US)

( * ) Notice: Subject to any disclaimer, the term of this patent is extended or adjusted under 35 U.S.C. 154(b) by 405 days.

(21) Appl. No.: 12/785,468

(22) Filed: May 23, 2010

(65) Prior Publication Data

US 2011/0126739 A1 Jun. 2, 2011

Related U.S. Application Data

(60) Provisional application No. 61/181,801, filed on May 28, 2009.

(51) Int. Cl.
*A47F 5/12* (2006.01)

(52) U.S. Cl.
USPC ..... 108/9; 108/27; 108/42; 108/98

(58) Field of Classification Search ..... 108/13, 108/26–27, 42, 91, 127, 44, 49, 97–98, 101, 108/38–39, 6, 9
See application file for complete search history.

(56) References Cited

U.S. PATENT DOCUMENTS 1,598,569 A * 8/1926 Fitzhugh ..... 108/49
2,328,471 A * 8/1943 Leffel ..... 108/6
2,547,642 A * 4/1951 Heuser ..... 108/147.21
2,710,051 A * 6/1955 Greenberg ..... 108/6
2,838,352 A * 6/1958 Kennedy ..... 108/9
2,973,603 A * 3/1961 De Vincenzo ..... 108/9
3,773,154 A 11/1973 Mitchell
4,044,980 A 8/1977 Cummins
4,159,071 A 6/1979 Roca
4,177,737 A 12/1979 Brickman
4,231,453 A 11/1980 Minor
4,389,946 A 6/1983 Hwang
4,431,231 A 2/1984 Elazari
4,436,353 A 3/1984 Tucker
4,565,403 A * 1/1986 Brown ..... 297/3
4,770,107 A 9/1988 Miller
4,856,627 A 8/1989 Polatov
4,887,536 A * 12/1989 Teichner ..... 108/35
4,972,781 A 11/1990 Montgomery
5,100,091 A 3/1992 Pollak
5,127,339 A 7/1992 Hood, Jr.
5,348,263 A 9/1994 Hubbard
5,443,018 A 8/1995 Cromwell
5,447,215 A 9/1995 Volkmar
5,470,041 A 11/1995 Cucinotta
5,628,439 A 5/1997 O'Hara
5,660,117 A 8/1997 Noble
5,992,406 A 11/1999 Lelle
6,000,345 A 12/1999 Gillotti
(Continued)

*Primary Examiner* — Hanh V Tran
(74) *Attorney, Agent, or Firm* — Ariel S. Bentolila; Bay Area IP Group, LLC

(57) ABSTRACT

An apparatus includes a surface panel for supporting objects in a first workspace. The surface panel includes a removable plug having a first flat surface and a second surface comprising rectilinear fingers for supporting devices in a generally upright position. A frame having a top side and a bottom side holds the surface panel above the top side and enables the surface panel to be positioned at a plurality angles relative to the frame. Appendages joined to the frame and deployable from the frame enable the frame and the surface panel to be supported a distance above a surface, where the distance is sufficient for enabling a second workspace between the frame and the surface.

18 Claims, 8 Drawing Sheets

U.S. PATENT DOCUMENTS

| | | | | |
|---|---|---|---|---|
| 6,036,011 | A | 3/2000 | DeCurtis | |
| 6,044,758 | A | 4/2000 | Drake | |
| 6,068,355 | A | 5/2000 | Thorp | |
| 6,131,929 | A | 10/2000 | Haley | |
| 6,229,693 | B1 | 5/2001 | Karidis | |
| 6,257,407 | B1 | 7/2001 | Truwit | |
| 6,293,206 | B1 | 9/2001 | Simon | |
| 6,439,133 | B1 | 8/2002 | Jaramillo | |
| 6,520,610 | B1 | 2/2003 | Miller | |
| 6,523,485 | B1 | 2/2003 | Cipolla | |
| 6,604,783 | B2 | 8/2003 | Goodson | |
| 6,659,319 | B2 | 12/2003 | Purpura | |
| 6,811,006 | B1 | 11/2004 | Mundle | |
| 6,827,028 | B1 | 12/2004 | Callaway | |
| 6,953,222 | B2 | 10/2005 | Larrick | |
| 6,997,111 | B2 | 2/2006 | Giegerich | |
| 7,055,442 | B2 | 6/2006 | Podd | |
| 7,073,449 | B2 * | 7/2006 | Pipkin | 108/44 |
| 7,172,167 | B2 * | 2/2007 | Phifer et al. | 248/460 |
| 7,252,040 | B2 | 8/2007 | Dumond | |
| 7,415,932 | B1 | 8/2008 | Hgo | |
| 7,545,634 | B2 | 6/2009 | Simonian | |
| 8,161,890 | B2 * | 4/2012 | Wang | 108/6 |
| 8,205,561 | B1 * | 6/2012 | Bierworth | 108/9 |
| 2002/0023811 | A1 | 2/2002 | Silvano | |
| 2002/0063072 | A1 | 5/2002 | Pham | |
| 2002/0066630 | A1 | 6/2002 | Brown, Sr. | |
| 2003/0079661 | A1 * | 5/2003 | Luu | 108/116 |
| 2004/0112258 | A1 * | 6/2004 | Fichman | 108/38 |
| 2006/0027146 | A1 * | 2/2006 | Lee | 108/6 |
| 2006/0037873 | A1 | 2/2006 | Elgart | |
| 2007/0039982 | A1 | 2/2007 | Carthern | |
| 2008/0072802 | A1 | 3/2008 | De Oliveira | |
| 2008/0149802 | A1 | 6/2008 | Chiang | |
| 2011/0056412 | A1 * | 3/2011 | Grammer et al. | 108/6 |

* cited by examiner

PORTABLE, COLLAPSIBLE, WORKSTATION TRAY TABLE APPARATUS

CROSS-REFERENCE TO RELATED APPLICATIONS

The present Utility patent application claims priority benefit of the U.S. provisional application for patent Ser. No. 61/181,801 and entitled "PORTABLE, COLLAPSIBLE, WORKSTATION TRAY TABLE DEVICE", filed on 28 May 2009 under 35 U.S.C. 119(e). The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to tables. More particularly, the invention relates to a tray table device.

BACKGROUND OF THE INVENTION

Trays, tables, and supports, exist and are among the most early and common of all human inventions. Some known devices currently support laptop computers or DVD players. There are also collapsible portable trays such as, but not limited to, bed trays for food service. Travelers on vehicles such as, but not limited to, airplanes, trains, and buses are typically provided a single tray table within a confined amount of space, and in some case no tray tables are provided. Current tray tables provide limited usable space and offer no separation of food and beverages from devices or items that could be damaged, such as, but not limited to, laptop computers, PDAs, books, DVD players, game players, or other devices known or unknown. For example, without limitation, the tray tables on the seat backs of airplanes are approximately 10.5 inches by 16 inches. They do not exceed the width of the seat back and fold upright along the seat back when not in use. In use, a tray table typically rests slightly above a traveler's lap and is in close proximity to the user's waist. This position on the body is often too low for extended visual use for items such as, but not limited to, laptops or DVD players and can cause strain and stress on the body's wrists, hands, arms, back, neck, head, and eyes. Currently, a person who is using a tray table at this level must bend their neck in a very strenuous position, often for long periods of time during flight or travel in order to use or enjoy devices placed on the tray table, which are commonplace in today's travel. Current tray tables give little or no options with positioning, and the angle of the seat back in front of the traveler can interfere with the use of laptop computers or DVD players. In some cases the preferred use of personal items on these tray tables may be prohibited by the low positioning and the lack of control of the seat back in front of the user.

The design of tray tables on airplanes was intended for food and beverage service and for general use such as, but not limited to, writing or reading a book or magazine. Today, however, portable electronic devices such as, but not limited to, iPods®, DVD players, laptops, CD players, and game players command more use and better use of the space the traveler has to occupy during transport. Laptops and DVD players can consume all of the flat space provided by the tray table, and during times when food or beverage is available the traveler must balance all of these items on one surface where liquids could harm their personal devices. Many travelers must hold the liquids in their hands for long periods of time in order to use the tray table for these devices, or travelers may need to stow or hold off on using their electronic devices during food and beverage service while in progress of work critical to their travel or while watching a film on a DVD player. Otherwise the traveler may have to balance food and beverage on the device, and liquids may be spilled on the device resulting in permanent damage. Furthermore, the storage of personal items under the seat on the airplane and limited access to the overhead bins due to seat location may cause some travelers stress concerning the storage of their devices.

While there are currently notebook stands and devices that support secondary devices such as laptop computers or books available that have adjustable angles for viewing, and there are trays and tables that are collapsible and portable that have stands or appendages, there are no such devices that have combined these elements to provide a collapsible table or tray coupled with a movable panel that provide multiple angles for viewing and support to secondary devices, such as but not limited to, laptop computers and books. Further in the category concerning collapsible tables and trays that exist, no current devices are within a size requirement that would allow them to operate in connection and conjunction with an airplane seat back tray or a table in a confined space such as found on an airplane or train.

In view of the foregoing, there is a need for improved techniques for providing a device to be used with tray tables that offers more space and positioning options and separates food and beverages from personal and electronic devices.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a side perspective view of a tray table device mounted to an existing tray table, and FIG. 1B is a side view of multiple users of tray table devices using these devices in various different manners; FIG. 2A is a side perspective view of the tray table device in a collapsed state.

2E is a side perspective view of the tray table device in an open state. FIG. 2V is an exploded view of the tray table device with an attachable cushion.

Figure 1A:
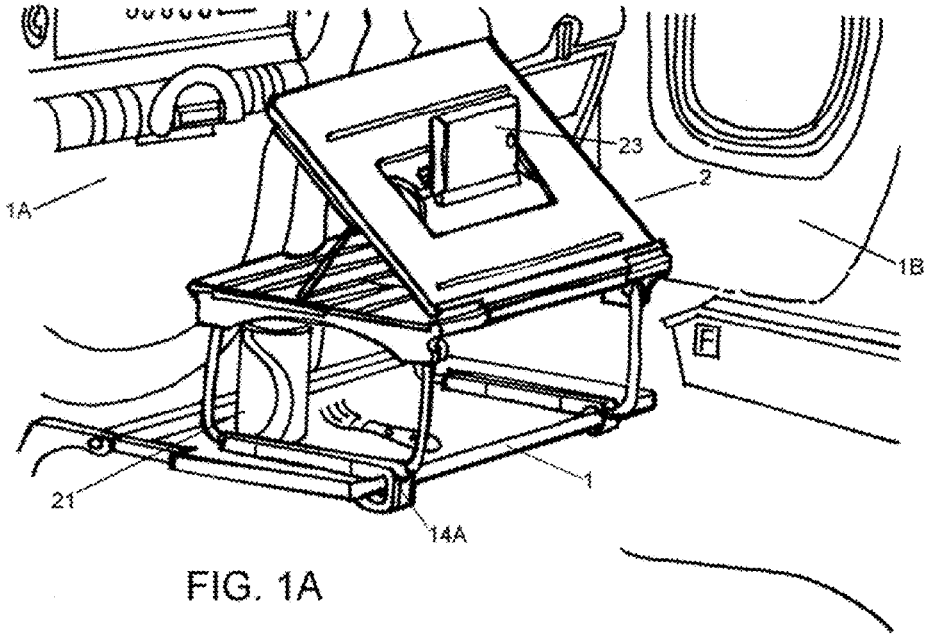
FIGS. 1A and 1B illustrate exemplary tray table devices in use in an airplane, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide a portable, collapsible, workstation tray table device. Preferred embodiments confront and address the issues of the fixed amount of available space on typical tray tables aboard vehicles such as, but not limited to, airplanes, trains, buses, boats, and automobiles and the lack of tray tables on some of these vehicles. Preferred embodiments provide additional usable space that may be manually mounted to the surface of an existing tray table. Preferred embodiments give users more flexibility in the positioning of the tray table surface by providing adjustable settings. Preferred embodiments also enable users to separate food and beverages from personal electronic or damageable items such as, but not limited to, laptop computers, DVD players, cellular phones, iPods®, PDAs, game players, books, magazines, etc.

Figure 1B:
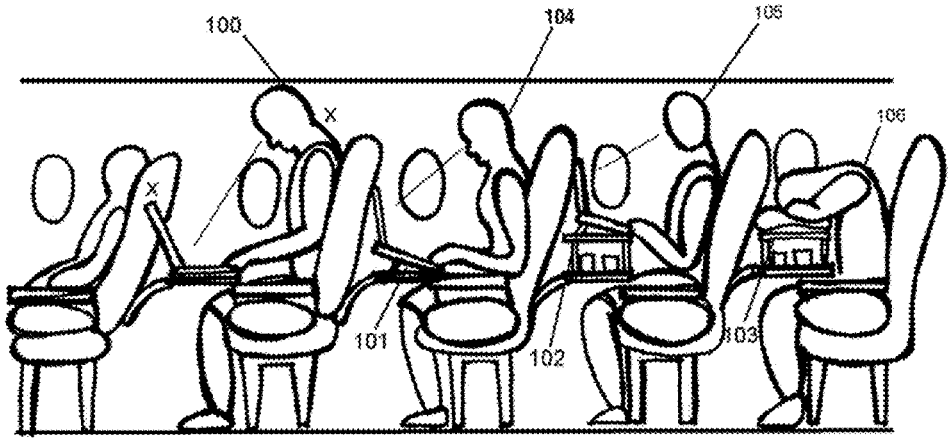

FIGS. 1A and 1B illustrate exemplary tray table devices in use in an airplane, in accordance with an embodiment of the present invention. FIG. 1A is a side perspective view of a tray table device 2 mounted to an existing tray table 1, and FIG. 1B is a side view of multiple users 104, 105 and 106 of tray table devices 101, 102 and 103 using devices 101, 102 and 103 in various different manners. In the present embodiment referring to FIG. 1A, tray table 1 is a compact surface that is collapsible and durable. Tray table 1 is approximately 16.5 inches by 10.5 inches by approximately 1 inch thick, which is a typical size for tray tables of this type, and is attached to a seat back 1A. Tray table device 2 is compact, collapsible, lightweight and durable and may be made of various materials including, without limitation, plastics, rubbers and metals. The dimensions of tray table device 2 preferably range from no greater than 16.5 inches by 10.5 inches to an approximate thickness of one half inch to 1.5 inches. However, tray table devices in alternate embodiments may be larger or smaller. In the present embodiment, tray table device 2 works in conjunction with the limits of space provided by environments such as, but not limited to, an airplane seat back tray table 1, where size is important for tray table device 2 to perform as desired. Tray table 2 preferably does not exceed the width of seat back 1A so that it may function properly. In the present embodiment, tray table device 2 is mounted to tray table 1 by mounting clips 14A.

Referring to FIG. 1A, in the present example, a small electronic device 23 such as, but not limited to, a cellular phone, iPod® or PDA is shown being used on tray table device 2. However, tray table device 2 may be used for many other purposes. For example, without limitation, a user can use tray table device 2 to ergonomically benefit the hands and wrists in connection with the orientation of a keyboard of a laptop at an angle on the surface of tray table device 2. The use of a manual angle change function on tray table device 2 can provide for a new visual sight line to a laptop or DVD player, which can improve viewing conditions for the user. Additionally, the user would have less strain on the neck. If the user is very tall, tray table device 2 can raise the device up off of the lap and may enable the taller user to work or enjoy their time during transit. Furthermore, when mounted to tray table 1, tray table device 2 can increase the amount of usable surface space by double and in some cases more. In the present embodiment, a separation of food and beverage 21 from electronic device 23 reduces the chance of harm of device 23 or other devices such as, but not limited to, laptop computers and DVD players.

Referring to FIG. 1B, the angle of the seat back in front of a tray table user 100 can interfere with the use of laptop computers or DVD players. The ability to control the angle of the surface and height of tray table devices 101, 102 and 103 enables users 104, 105 and 106 to work or enjoy their time while reducing the amount of stress and strain on their body. In typical use of the present embodiment once a user has located their seat on an airplane, the user can open the tray table on the seat back in front of him and manually place the tray table device onto the tray table. The user then has multiple options for orienting the tray table device for the desired support for the user's secondary devices such as, but not limited to, laptop computers, DVD players, or the like. For example, without limitation, user 104 has chosen to manually open a surface panel on tray table device 101 in order to avoid the seat back in front of him from reclining and blocking the use of a laptop computer screen. User 105 of tray table device 102 has chosen to deploy a stand appendage of tray table device 102 to raise the work surface of tray table device 102 several inches above the existing tray table on the airplane seat back. User 106 of tray table device 103 has deployed the stand appendage of tray table device 103 to raise the surface in order to rest his head on this surface. Passengers on long fights who often have a lack of options to find a comfortable resting position for the body are confronted with the current limits of space and confinement. This problem is greater where the passenger is in a middle seat and does not have an interior wall of the airplane to lean against for support during rest. These passengers often lean forward using an arm or both arms to connect, stabilize, or prop up their resting position on the seat back tray to find support for rest. Often the arms and wrists are strained in this position and its short lived. With the elevation from tray table device 103, tray table device 103 provides support to passengers as a forward leaning support to rest their heads in comfort.

Figure 2A:
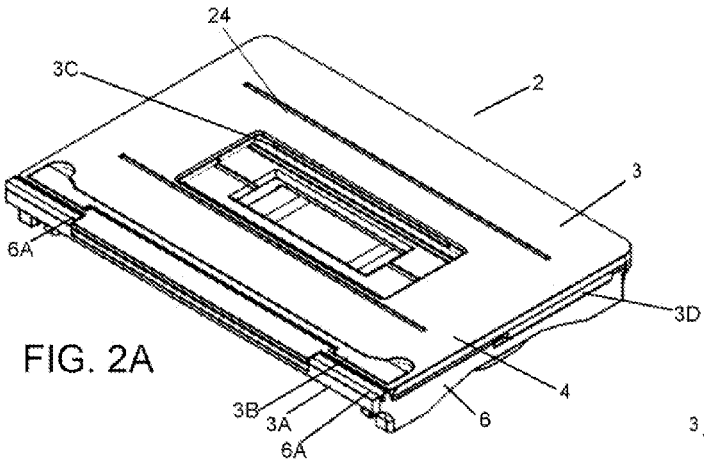
FIGS. 2A through 2V illustrate various views of an exemplary tray table device, in accordance with an embodiment of the present invention.
Figure 2B:
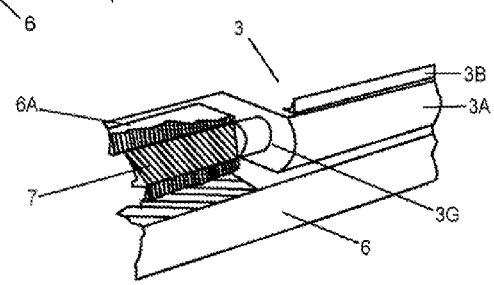
FIG. 2B is a detailed and partially cut-away view of a frame surface panel hinge.
Figure 2C:
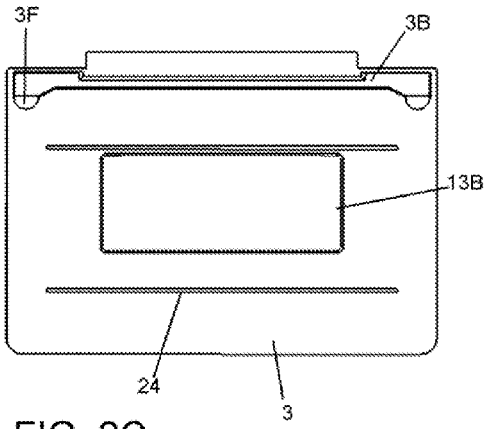
FIG. 2C is a diagrammatic top view of a surface panel.
Figure 2D:
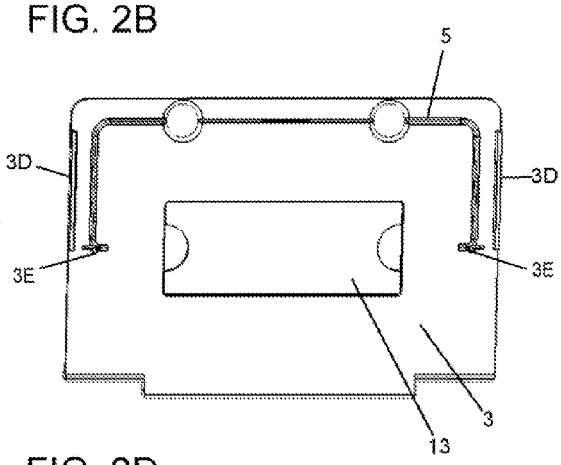
FIG. 2D is a diagrammatic bottom view of the surface panel. FIG.
Figure 2E:
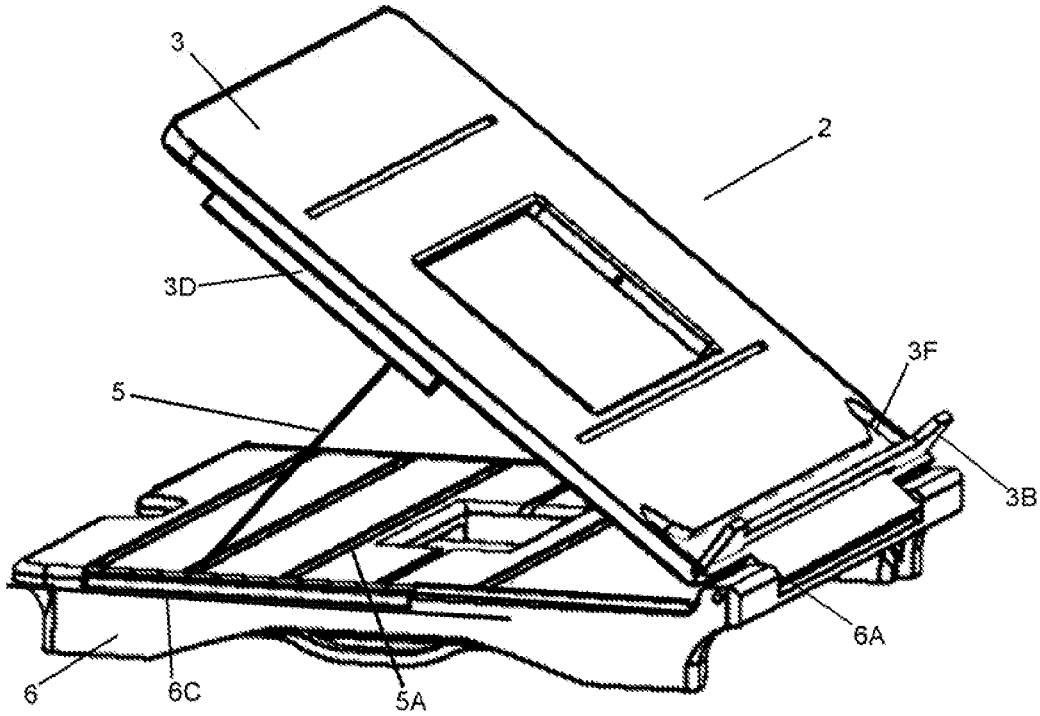
FIG. 2F is a diagrammatic side view of the tray table device.
FIG. 2G is a side perspective view of the tray table device with stand appendages extended.
FIG. 2H is a side perspective view of the tray table device with a removable plug removed.
FIG. 2I is a side perspective view of the tray table device with a small electronic device being held by rectilinear fingers.
FIG. 2J is a diagrammatic top view of a frame.
FIG. 2K is a diagrammatic bottom view of the frame.
FIG. 2L is a side perspective view of a stand appendage and a mounting clip.
FIG. 2M is a side perspective view of the bottom of the frame.
FIG. 2N is a side perspective view of the tray table device mounted on a tray table.
FIG. 2O is a side perspective view of the bottom of the frame with the stand appendages extended.
FIG. 2P is a side perspective view of the bottom of a frame stand hinge.
FIG. 2Q is a diagrammatic side view of the frame stand hinge.
FIG. 2R is a side perspective view of the bottom of the frame with the stand appendages collapsed.
FIG. 2S is a diagrammatic bottom view of the frame with the stand appendages removed.
FIG. 2T is a bottom perspective view of the tray table device mounted to the tray table.
FIG. 2U is a diagrammatic rear view of the tray table device mounted to the tray table.
Figure 2F:
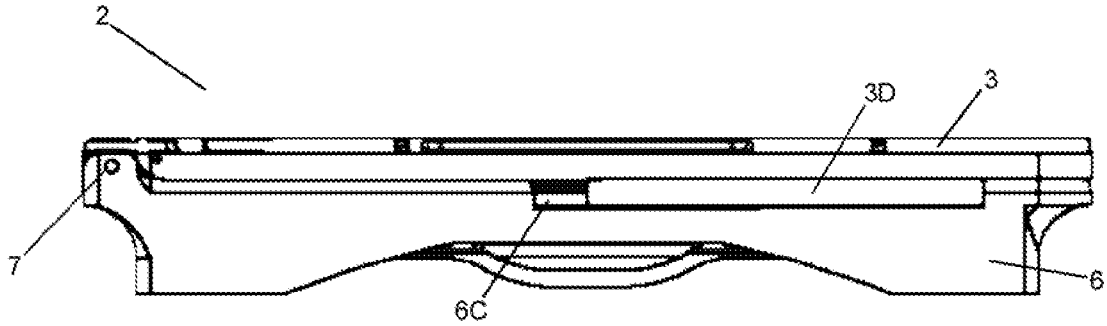
Figure 2G:
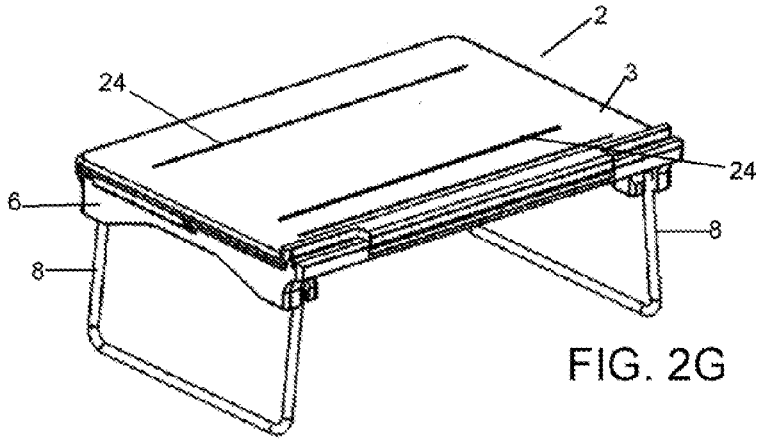
Figure 2H:
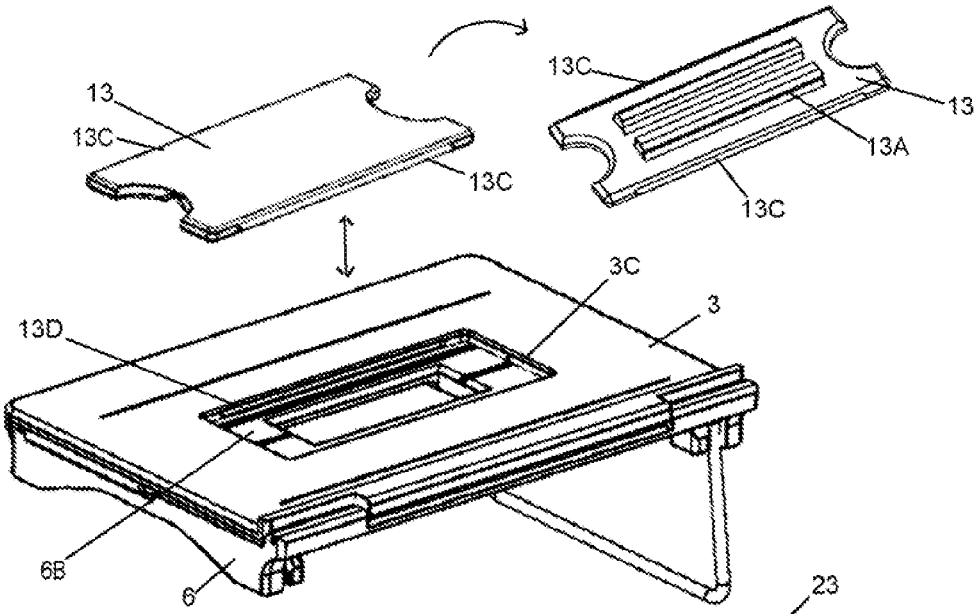
Figure 2I:
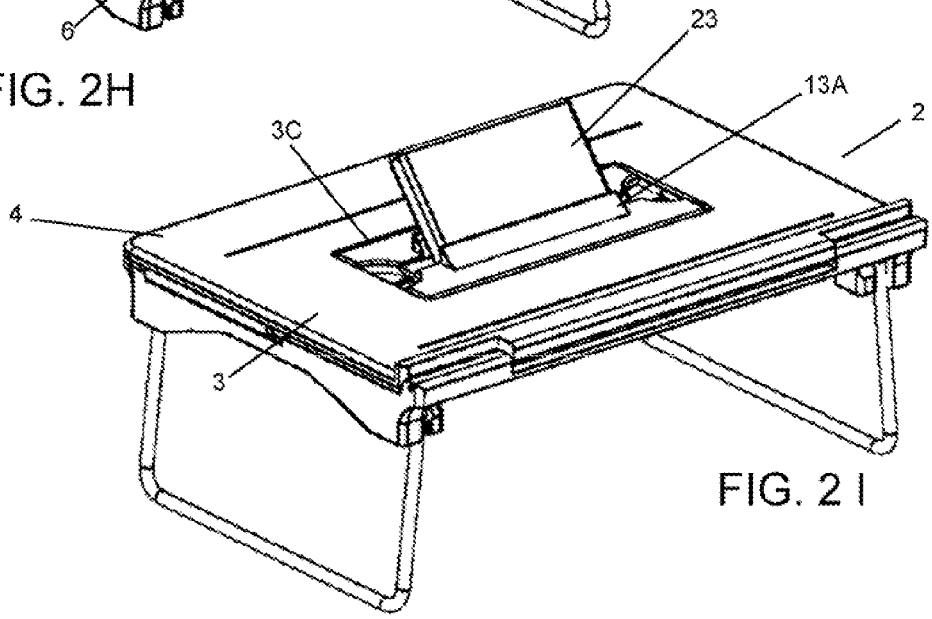
Figure 2J:
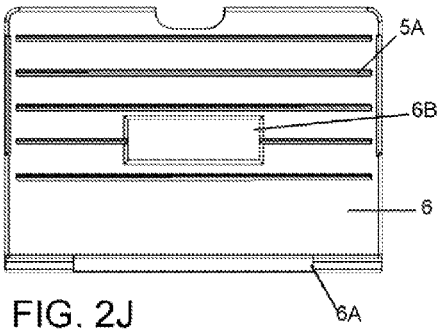
Figure 2K:
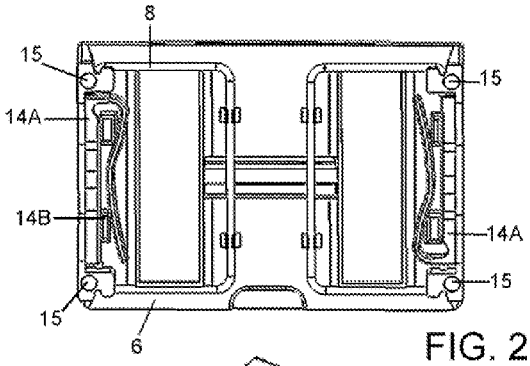
Figure 2M:
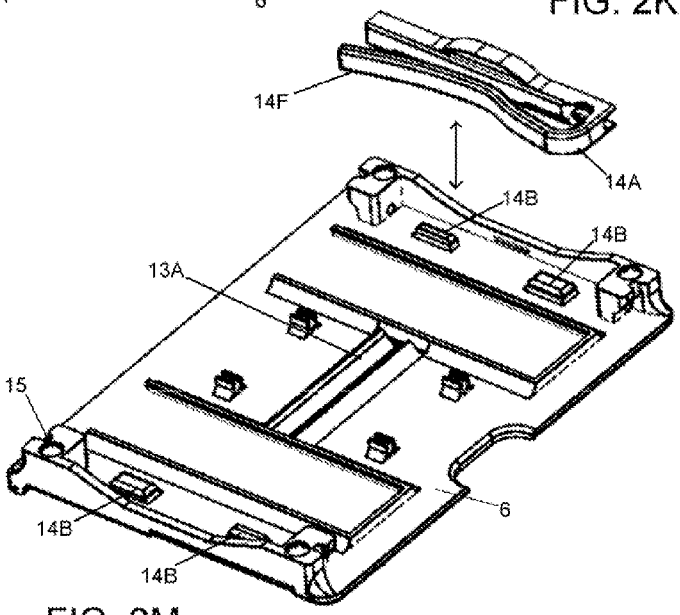
Figure 2L:
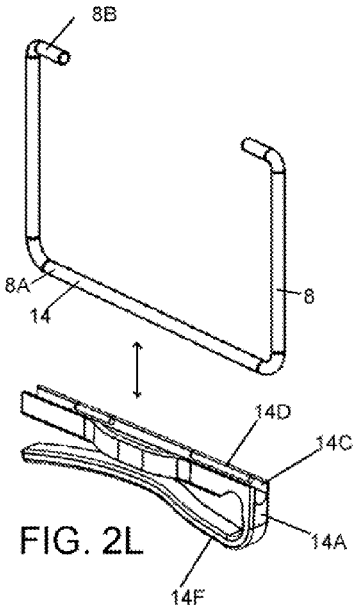
Figure 2N:
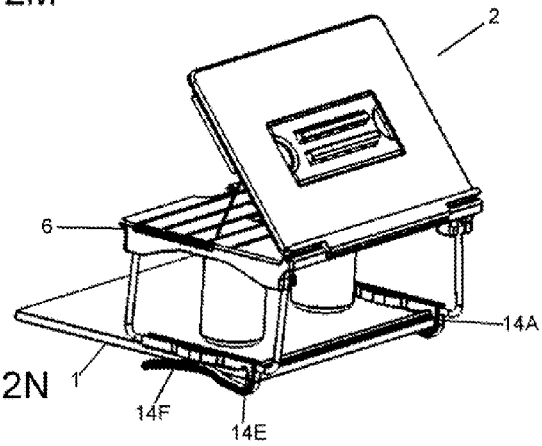
Figure 2O:
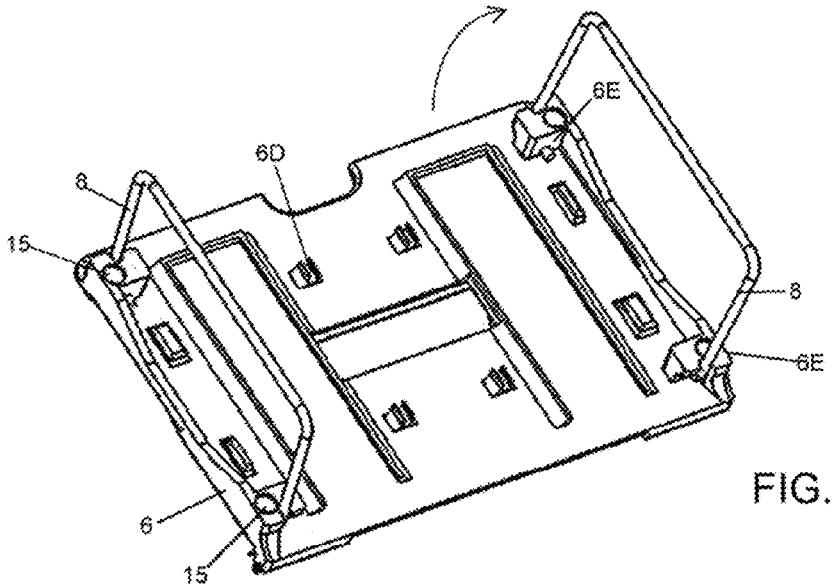
Figure 2P:
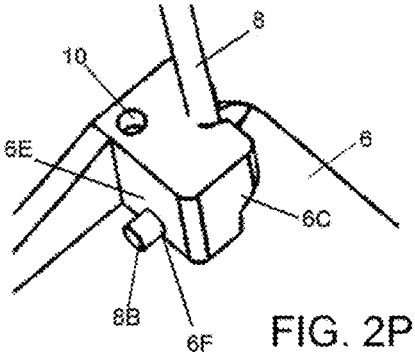
Figure 2Q:
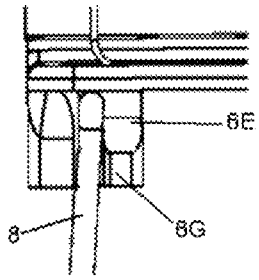
Figure 2R:
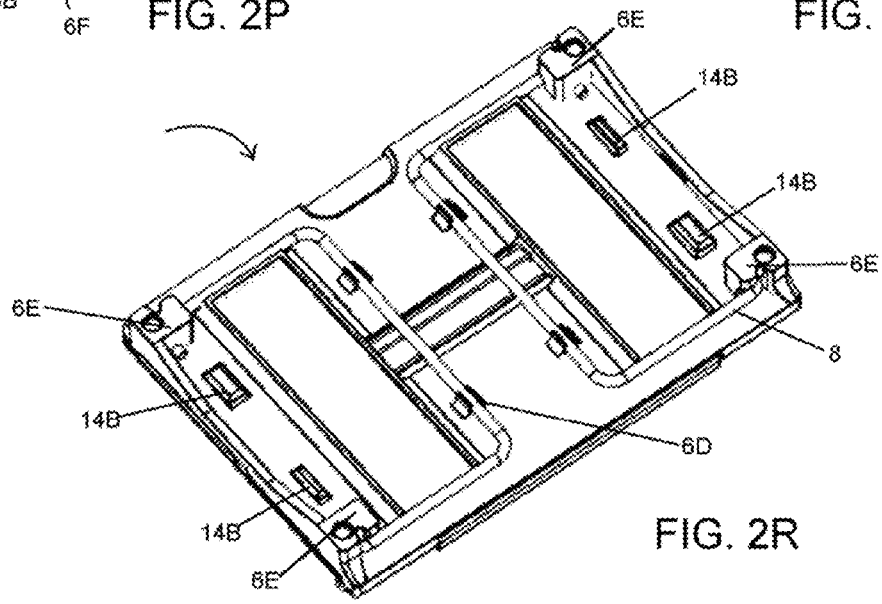
Figure 2S:
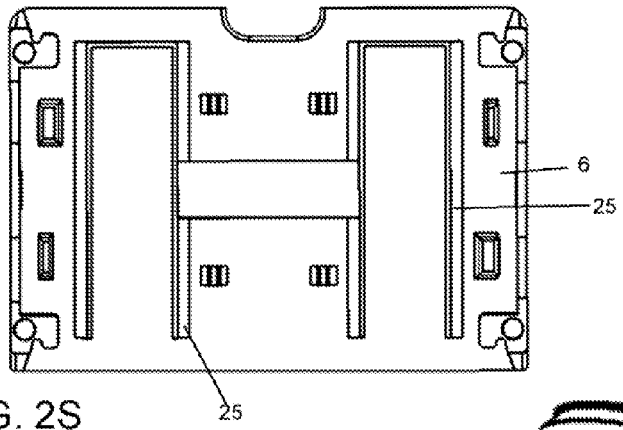
Figure 2T:
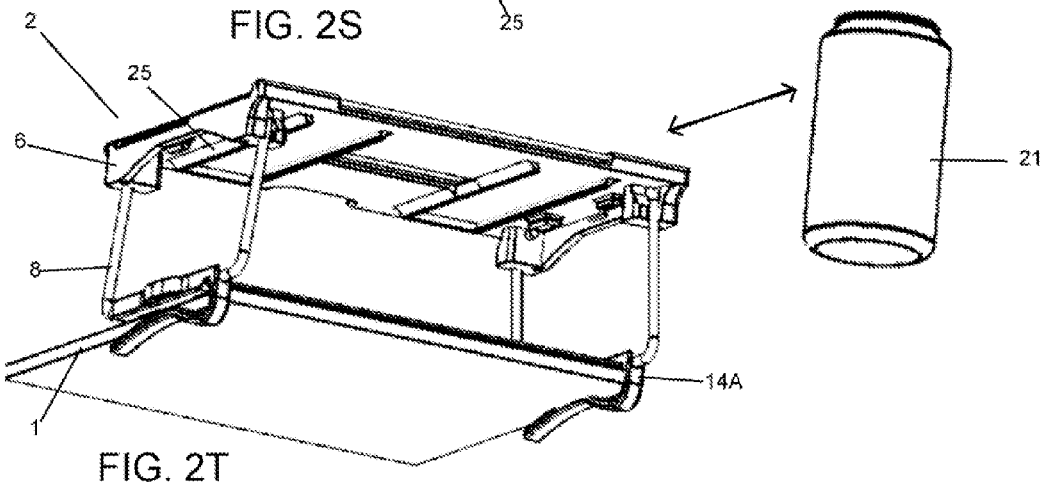
Figure 2U:
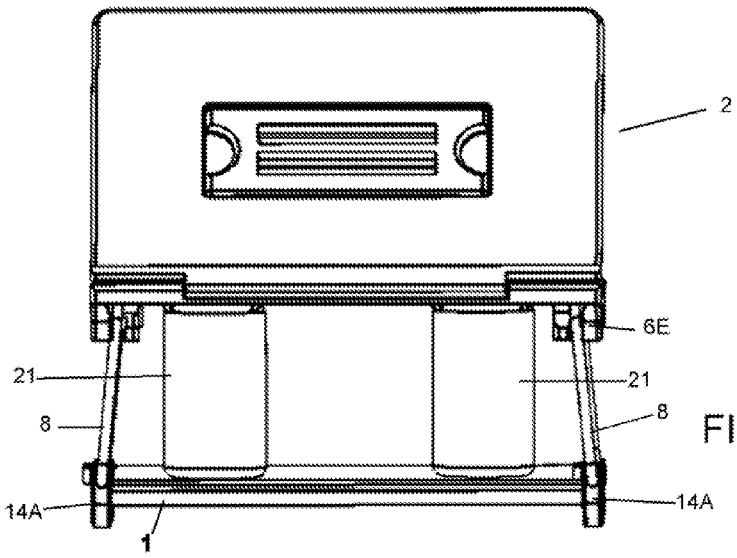
Figure 2V:
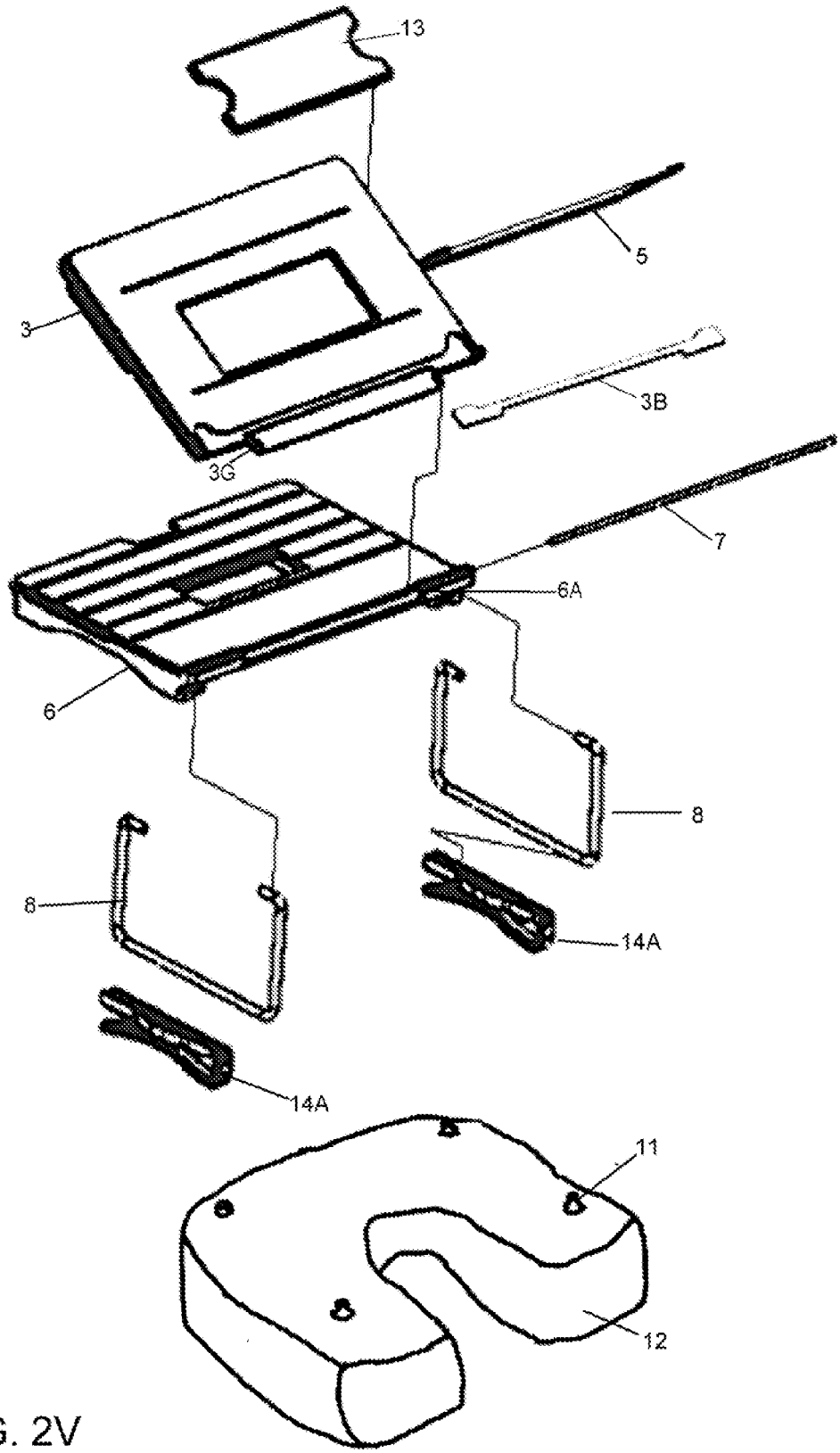

FIGS. 2A through 2V illustrate various views of an exemplary tray table device 2, in accordance with an embodiment of the present invention. FIG. 2A is a side perspective view of tray table device 2 in a collapsed state. FIG. 2B is a detailed and partially cut-away view of a frame surface panel hinge 6A. FIG. 2C is a diagrammatic top view of a surface panel 3. FIG. 2D is a diagrammatic bottom view of surface panel 3. FIG. 2E is a side perspective view of tray table device 2 in an open state. FIG. 2F is a diagrammatic side view of tray table device 2. FIG. 2G is a side perspective view of tray table device 2 with stand appendages 8 extended. FIG. 2H is a side perspective view of tray table device 2 with a removable plug 13 removed. FIG. 2I is a side perspective view of tray table device 2 with a small electronic device 23 being held by rectilinear fingers 13A. FIG. 2J is a diagrammatic top view of a frame 6. FIG. 2K is a diagrammatic bottom view of frame 6. FIG. 2L is a side perspective view of a stand appendage 8 and a mounting clip 14A. FIG. 2M is a side perspective view of the bottom of frame 6. FIG. 2N is a side perspective view of tray table device 2 mounted on a tray table 1. FIG. 2O is a side perspective view of the bottom of frame 6 with stand appendages 8 extended. FIG. 2P is a side perspective view of the bottom of a frame stand hinge 6E. FIG. 2Q is a diagrammatic side view of frame stand hinge 6E. FIG. 2R is a side perspective view of the bottom of frame 6 with stand appendages 8 collapsed. FIG. 2S is a diagrammatic bottom view of frame 6 with stand appendages 8 removed. FIG. 2T is a bottom perspective view of tray table device 2 mounted to tray table 1. FIG. 2U is a diagrammatic rear view of tray table device 2 mounted to tray table 1, and FIG. 2V is an exploded view of tray table device 2 with an attachable cushion 12.

In the present embodiment, tray table device 2 is preferably compact for transport in a limited space such as, but not limited to, carry-on bags or briefcases. Once in the desired environment, tray table device 2 is able to expand to achieve its goals. Tray table device 2 transforms into multiple surface platform configurations including the flat collapsed position, which can be placed onto the surface of a tray table. Surface panel 3 may also be opened to acts as a prop for devices such as, but not limited to, laptops, game systems, iPods®, etc. Stand appendages 8 may also be extended to raise surface panel 3 off of the tray table.

In the present embodiment, tray table device 2 comprises: substantially rectangular surface panel 3 comprising one or more hinged swing arm supports 5 and a rectilinear opening 3C able to accept removable plug 13 comprising parallel rectilinear fingers 13A on one side able to support small electronic devices such as, but not limited to, media players; substantially rectangular frame 6 comprising a central aperture 6B able to accept removable plug 13, frame 6 being hingedly attached at one end to surface panel 3, situated underneath surface panel 3, and able to support surface panel 3 in an included configuration by supporting hinged swing arm 5, frame 6 further comprising a stand appendage 8 on either side able to support frame 6 and providing a clearance underneath frame 6. Also included are two mounting clips 14A that detach from the underside of frame 6 and may be mounted to a secondary tray or table where tray table device 2 may then mount to the table or tray. Some embodiments may also comprise attachable cushion 12 that is removably connected to the undersurface of frame 6.

In the present embodiment, tray table device 2 is collapsible and portable and can travel in a briefcase, carryon bag, purse, backpack, etc. When deployed by a user, tray table device 2 may be mounted to the flat surface of tray table 1, thus doubling the amount of useable space for the traveler and creating the ability to separate food and beverages 21 from items such as, but not limited to, laptops, DVD players, and books, enhancing the productive use of personal items and their simultaneous use during the service of food and beverage 21. The introduction of tray table device 2 to tray table 1 enables the user to control the height and angle of tray table device 2 through the use of adjustable stand appendages 8 and a movable surface panel 3 thus reducing the amount of stress and strain on the body. Where a tray table is not provided during transportation and the need for personal items and devices are required, tray table device 2 has the ability to be a lap support for devices and items such as, but not limited to, a book, a laptop or an iPod®. Tray table device 2, due to the confinements of space on an airplane or other vehicle, is designed to not exceed the limits of the available space.

Referring to FIGS. 2A, 2B and 2C, surface panel 3, which is the top element of tray table device 2, is preferably no greater than 16.5 inches by 10.5 inches with a thickness of one half inch to 1.5 inches and is the same approximate dimensions as frame 6, which supports surface panel 3. Surface panel 3 has a surface coating 4 that is made of a flexible plastic or rubber material that covers surface panel 3. Surface panel 3 also comprises rubberized strips 24. Surface coating 4 on surface panel 3 and rubberized strips 24 can interact and hold items in place while in transport along with a surface panel raised bar 3B, which may be attached in a fixed or movable manner on surface panel 3. As the angle of surface panel 3 increases, rubber or textured surface coating 4 of surface panel 3 in addition to rubberized strips 24 assist in creating a semi-permanent bond between a secondary device such as, but not limited to, an iPad®, laptop computer or book and surface panel 3 at the angle desired by the user and their orientation of viewing and use. The weight of some items may require additional support beyond surface coating 4 and rubberized strips 24 when the angle increases beyond certain degree to prevent the item from sliding. In this case, raised bar 3B may be used to provide a stop for the item. In alternate embodiments, a raised bar alone may be used to keep the item on the surface panel. Yet other alternate embodiments may not comprise a raised bar and may rely on the surface coating to hold items on the surface panel.

In the present embodiment, approximately in the center of surface panel 3 is rectilinear opening 3C into which removable plug 13 may be inserted. Referring to FIG. 2B, a front edge 3A of surface panel 3 is an area approximately 5 inches to 8 inches long by approximately a quarter of an inch wide. On the top of front edge 3A, running the same length, is raised bar 3B. Raised bar 3B is a part of surface panel 3 and is made of the same material. In the present embodiment, raised bar 3B may be raised to create a lip near front edge 3A of surface panel 3 to help hold items on surface panel 3 and is able to collapse into a bar cavity 3F to enable the surface of surface panel 3 to be flush when not in use for easier carrying. In alternate embodiments, the raised bar may be attached to the surface panel in a fixed position. In the present embodiment, the entire length of front edge 3A comprises a half circle curve that runs from the top edge of surface panel 3 to the bottom edge of surface panel 3.

Referring to FIGS. 2A, 2B and 7, surface panel 3 has a surface hole 3G running through surface front edge 3A into which a tubular rod 7 fits. Tubular rod 7 exits on both sides of surface panel 3 and fits into frame hinges 6A that are built into frame 6 and are located on each side of surface panel 3 to hold surface panel 3 to frame 6. The curved edge of surface front edge 3A enables surface panel 3 to lift away from frame 6 yet remain connected to frame 6 by tubular rod 7 and frame hinges 6A on front edge 3A of surface panel 3A. The curve of front edge 3A enables surface panel 3 to move at an upward or downward angle from frame 6, thus enabling devices placed upon surface panel 3 to be used in a manner desired by the user. Those skilled in the art, in light of the preset teachings, will readily recognize that alternate means for movably attaching surface panel 3 to frame 6 such as, but not limited to, mechanical hinges, a flexible piece of material connecting surface panel 3 and frame 6, etc.

Referring to FIG. 2D, in the present embodiment, under surface panel 3 is swing arm support 5, which is hinged on each side by molded surface panel sockets 3E that hold swing arm support 5 enabling it to move freely away from under surface panel 3 yet remain connected to surface panel 3. Referring to FIG. 2E, swing arm support 5 can be positioned in various angles that support surface panel 3 above. Frame 6 below swing arm support 5 acts as a base when the foot of swing arm support 5 is stationed upon it.

Referring to FIGS. 2E and 2F, a protruding rib 3D on the underside of surface panel 3 fits into a catch mount 6C of frame 6 when surface panel 3 and frame 6 are parallel to each other to form a lock holding surface panel 3 and frame 6 together. In the present embodiment, protruding rib 3D is coated with a flexible material such as, but not limited to, rubber, where rib 3D can fit and the material expands to hold surface panel 3 tight and in place against frame 6. Manual pressure from a user's hand can separate and join the frame 6 and surface panel 3. For example, without limitation, to open surface panel 3, the user unlocks protruding rubberized rib 3D from frame catch mount 6C by hand with upward pressure thus releasing surface panel 3 from frame 6. The user may then adjust swing arm support 5 under surface panel 3 to the desired angle of use. In alternate embodiments, various different means may be used to hold the surface panel and the frame together such as, but not limited to, claps, straps, buckles, etc. Other alternate embodiments may not include any means for holding the surface panel and the frame together.

Referring to FIG. 2E in the present embodiment, when tray table device 2 is raised from the collapsed position to an ergonomic position with surface panel 3 at an angle, tray table device 2 is able to support other devices placed upon tray table device 2 for better usage and visibility and more control. The ergonomic position can be achieved when surface panel 3 is unlocked from frame 6 with manual pressure from the hand to release protruding rib 3D from catch mount 3C and opened to the desired angle for viewing. Surface panel 3 is then locked into position with the insertion of swing arm support 5 under surface panel 3 and onto a stand track 5A on the top surface of frame 6. Frame 6 preferably comprises multiple stand tracks 5A to enable swing arm support to be locked into various different positions. Once the desired angle of surface panel 3 is achieved, a device such as, but not limited to, a laptop or DVD player may be placed on top of surface panel 3. Raised bar 3B may be raised from bar cavity 3F to provide added support to the device placed on surface panel 3. Referring to FIG. 2G, tray table device 2 may be raised several inches above the surface on which it is placed by extending stand appendages 8 to provide more adjustability to tray table device 2. This also enables food and beverages to be placed under frame 6 to keep food and beverages separate from items that may be used on surface panel 3, as shown by way of example in FIGS. 2N and 2U.

Referring to FIG. 2H, in the center of surface panel 3 is removable plug 13. When manual pressure from the hand is applied under frame 6 and onto removable plug 13 in an upward motion, removable plug 13 ejects from the top of surface panel 3 leaving rectilinear opening 3C in surface panel 3 in the same dimensions of the top orientation of removable plug 13 and central aperture 6B in frame 6, which is a smaller opening than rectilinear opening 3C in surface panel 3. Running along each side of removable plug 13 are plug hinges 13C, which lock into plug tracks 13D inside rectilinear opening 3C in surface panel 3.

Referring to FIG. 2H, the smaller size of central aperture 6B in frame 6 under removable plug 13 generally prevents removable plug 13 from passing though frame 6. Referring to FIG. 2I, when removable plug 13 is flipped from top to bottom, the underside of removable plug 13 reveals rectilinear fingers 13A. Rectilinear fingers 13A create a flexible mount into which a small device 23 such as, but not limited to, a PDA, an iPhone®, or an iPod® may be inserted. Rectilinear fingers 13A increase the height and support of device 23. Removable plug 13 can be placed in rectilinear opening 3C with rectilinear fingers 13A facing upward or facing downward. Surface coating 4 surrounding removable plug 13 contracts and expands holding removable plug 13 in place in the center of surface panel 3. The two different sides of removable plug 13 enable tray table device 2 to remain compact for travel and the demands of limited personal space during carrying, storage and other space-limited activities. When removable plug 13A and surface panel 3 are flat, they form a uniform single-plane working surface.

In alternate embodiments the plug may be attached to the surface panel with a pin that enables the plug to rotate from a flat side to a side with rectilinear fingers or other features. Also in alternate embodiments the shape of the removable plug may be circular or square or many other shapes and the placement of the removable plug may be off center or at various other locations on the device. In one alternate embodiment, the removable plug may be formed into a circular shape that allows for a beverage to placed into it. Other alternate embodiments may be implemented without a removable plug.

Referring to FIG. 2J, the top of frame 6 is shown illustrating stand tracks 5A, panel hinges 6A and central aperture 6B. Referring to FIGS. 2K and 2M, the underside of frame 6 is shown illustrating stand appendages 8 in a collapsed state, mounting clips 14A, mounting locks 14B, and stand caps 15. When surface panel 3 is collapsed onto frame 6 and presented on a flat surface such as, but not limited to, a tray table, tray table device 2 forms a stable bond with the flat surface with the use of rubberized stand caps 15 on the underside of frame 6. Stand caps 15 create a suction that allow for stability of tray table device 2 to join to the flat surface when air pressure is trapped between flexible rubberized stand caps 15 and the flat surface.

Referring to FIGS. 2K, 2L and 2M, mounting clips 14A can be made of metal, plastic, wood or other materials known or unknown or a combination of two or more materials formed together. Referring to FIG. 2K, when not in use two mounting clips 14A are connected to frame 6 and held in place by one or more mounting locks 14B. Referring to FIG. 2L, mounting clip 14A is orientated in a position to allow stand appendage 8 to be pressed by hand into a clip track 14C on the upright portion of mounting clip 14A. A stand appendage foot 8A on stand appendage 8, when pressured by hand into clip track 14C, slides under clip track locks 14D creating a stable bond between mounting clip 14A and stand appendage 8. Incasing stand appendage foot 8A is a flexible mount 14 that is rubberized or made of a strong flexible plastic material known or unknown. Stand appendage joints 8B at the top of stand appendage legs 8D attach stand appendage 8 to frame 6. Mounting clips 14A are removably attached to the underside of frame 6. However, in alternate embodiments, the mounting clips can be designed and formed to be fixed-unmovable parts joined or fabricated to the feet of the stand appendages.

In the present embodiment, referring to FIG. 2N, tray table device 2 can be attached to tray table 1, or other flat surfaces that fit the dimensions of mounting clips 14A, by using the hand to slide tray table 1 into the center of mounting clips 14A. A clip pressured tail 14F made of a strong flexible material such as, but not limited to, plastic or metal uses a bent curve to apply pressure and to recover its shape once tray table 1 enters the space inside mounting clip 14A. Clip pressured tail 14F creates a stable connection and enables mounting clips 14A to support tray table device 2 once stand appendages 8 attached to frame 6 are connected into clip track 14C thus enabling other devices such as, but not limited to, laptop computers to be used on tray table device 2. A clip notch 14E on the front of mounting clip 14A can allow tray tables that have a protruding bar on the front to be used with mounting clip 14A by enabling the bar to pass through clip notch 14E.

Flexible mount 14 may be formed with a concave shape allowing air to become trapped between a flat unified surface such as tray table 1 and, with pressure, create a suction and thus a bond between tray table device 2 and tray table 1 and or mounting clip 14A. This enables tray table device 2 to be connected to tray table 1 or other flat surface without mounting clips 14A; therefore, some alternate embodiments may be implemented without mounting clips. This connection of tray table device 2 to tray table 1 using flexible mount 14 to connect directly to tray table 1 provides marginal to good support of tray table device 2; however, flexible mounts 14 in conjunction with mount clips 14A provide superior connection, stability and weight load.

Referring to FIGS. 2O, 2P, 2Q, and 2R, in the present embodiment, under frame 6 are two stand appendages 8 that are held in place by frame stand hinges 6E that are located on the underside of frame 6. Stand appendage joints 8B are inserted into frame hinge holes 6F, and frame stand hinges 6E surround stand appendage joints 8B and enable the round surfaces of each stand appendage joint 8B to rotate and be concealed inside frame stand hinges 6E, which enable stand appendages 8 to move in an approximately 80 to 90 degree angle to frame 6. In the present embodiment, tray table device 2 manually transforms from a compact self-contained position, as shown by way of example in FIG. 2A, into various different stages of expansion. Referring to FIGS. 2O and 2R, the stages of how stand appendages 8 are manually rotated and moved into a locked position of 90 to 80 degrees are shown. Referring to FIGS. 2P and 2Q, detailed views show how frame hinges 6E on the underside of frame 6 hold stand appendages 8 at stand appendage joints 8B. The cylindrical shape of stand appendages 8 and the curved interior shape of frame stand hinges 6E allow for free movement along this curve's edge, thus enabling stand appendages 8 to support frame 6 and create a table position of tray table device 2. Stand appendages 8 lock into position when frame catch mounts 6G come into contact with the inverse shape of stand appendages 8 so that tray table device 2 does not collapse when items are place upon it. In the collapsed position, stand appendages 8 are held in place by frame stand locks 6D.

Referring to FIGS. 2S, 2T and 2U in the present embodiment, two independent soda tracks 25 are included on the underside of frame 6. In alternate embodiments more or fewer soda tracks may be included, and in other alternate embodiments, no soda tracks may be included. In the present embodiment, soda tracks 25 work with industry standard soda cans and can be adjusted for future shifts in the market concerning the lock and hold of cans in relationship to the height of tray table device 2. Currently, soda tracks 25 are configured to hold a can 21 of soda or beer, or another liquid, in place. Once the erected tray table device 2 is mounted to tray table 1, cans 21 can be slid and held in place so not to fall over and spill. Additionally, the weight load to tray table device 2 can be increased when cans 21 are inserted into soda tracks 25 under frame 6. By inserting cans 21 into soda tracks 25, the weight-bearing load is increased to support an average adult's upper body weight. Cans 21, frame 6 and tray table 1 make a single contact for distributing weight. This coupled with stand appendages 8 and mounting clips 14A create a stable and strong platform for a forward headrest.

Referring to FIGS. 2P and 2V, under frame 6 are four clasps 10. Alternate embodiments may comprise more or fewer clasps or no clasps. In the present embodiment, clasps 10 are concealed under stand caps 15, which hold tray table device 2 in place when resting or in use without stand appendages 8 on a flat surface such as, but not limited to, a tray or a table. Snaps 11 are made to snap together with clasps 10 so that other items such as, but not limited to, attachable cushion 12 can make a stable connection with tray table device 2. Those skilled in the art, in light of the present teachings, will readily recognize that a multiplicity of suitable items exist that may be attached to the bottom of tray table device 2 with the use of snaps 11 and clasps 10 such as, but not limited to, straps for carrying tray table device 2, covers for tray table device 2 or cases for personal items such, but not limited to, cellular phones, laptop computers, books, magazines, etc.

In the present embodiment, the typical use for tray table device 2 is for a mobile person that needs to be productive and wants to maximize their time in predicable and unpredictable locations they may encounter during travel or during stationary periods. Tray table device 2 starts in the most compact and non-assuming form possible to perform the greatest amount of function for supporting personal and leisure devices such as, but not limited to, a laptop, DVD player, book, or game-player, which are also traveling with the user in the limited space provided in an airplane, train or bus. In this collapsed state, tray table device 2 is non-assuming yet provides functionally as it may be used a clipboard or support placed on the user's lap to support other devices for work or leisure. Tray table device 2 may also be stored in a carryon bag, computer case or brief case when in this collapsed state, and can add protection and support to the interior of the case and the items within the case.

Those skilled in the art, in light of the present teachings, will readily recognize that embodiments of the present invention may be employed in many situations other than when traveling. For example, without limitation, tray table device 2, due to size and the ability to transform into multi use platforms, may be used on a space station or submarine where space and usage of space is critically important. Furthermore, the flexible mounting feet can create a suction onto a flat surface to hold tray table device 2 in environments that are moving or without gravity. Tray table device 2 can be used as clipboard for a traveler or a worker performing fieldwork who needs a flat surface to conduct surveys and reports and then needs to use a table for the support of other devices such as, but not limited to, laptops. Tray table device 2 could be used during press junkets, where many reporters do not have the amount of space needed to conduct their mobile affairs or to blog and write. Here tray table device 2 is able to create working solutions and still remain compact and non-assuming. Tray table device 2 may be used for motion picture production where various departments on location are confronted with the lack of space. The elements of tray table device 2 would provide greater ability and ease to conduct their affairs. Tray table device 2 may be an addition to a hospital tray where a person is restricted in movement and the amount of space given to them.

In the present embodiment, various different types of material may be used to construct the components of tray table device 2. If plastic, acrylic or synthetic materials known or unknown are used for frame 6 and surface panel 3, injection molds can be made and then injected with the desired material to create these parts. If metal is to be used to create tray table device 2, the desired metal is milled and then cut with a laser or automated saw and/or drill to achieve the several individual parts, for example, without limitation, surface panel 3, frame 6 and stand appendages 8. From here the various parts requiring it, are coated with rubberized materials. If wood is to be used to construct tray table device 2, a laser, automated saw or wood-forming technology known or unknown may be used to create frame 6 and surface panel 3 where a rubberized coating is applied with adhesives or other material know or unknown. Once surface panel 3 is dye cut or molded to its desired size, it is surface coated with a rubberized material that enables other devices to be held onto surface panel 3. If stand appendages 8 need to support a weight limit greater than 40 lbs, metal is preferably used; however, wood, plastics or other material known or unknown can also be used. Stand appendages 8 are separately formed into one seamless unit. The process of forming stand appendages 8 includes cutting, molding or bending the material into shape so that stand appendages 8 can be pressed into frame hinges 6E on the underside of frame 6. The attachment of stand appendages 8 to frame 6 may be done manually or mechanically. Flexible mounts 14 may be molded onto stand appendages 8 during the process of forming stand appendages 8 or assembled onto stand appendages 8 after manual attachment to frame 6. Attaching flexible mounts 14 may be a heat process or an adhesive process and may be done manually or mechanically. In some embodiments tray table device 2 may be made of clear plastics or other transparent materials to enable the user view through the tray table device 2 to view items below on tray table 1.

In alternate embodiments, the stand appendages may be configured differently. For example, without limitation, in one alternate embodiment, the stand appendages may have four separate legs that hold the frame above the tray table below. In another alternate embodiment, the stand appendages could form a collapsible X-shape that has a scissor motion that can lock into place when deployed or collapsed. In yet another alternate embodiment, the stand appendages unfold from the front underside of the frame and the back underside of the frame rather than the sides of the frame under the tray table device. In yet another alternate embodiment, the repositioned stand appendages could retract allowing for more space under the tray table device for large items to be placed. In yet another alternate embodiment, the feet on the stand appendages could form a clamp to lock onto the tray table. In yet other alternate embodiments, removable stand appendages could be added to the tray table device to create the table position.

In an alternate embodiment of the present invention, the frame folds into a box and shelf with hinges similar to a lawn chair that enables the frame to bend and lock into place. In this embodiment, one surface item forms a table or a tray that allows for food and beverage to be severed on an uninterrupted surface from other devices such as, but not limited to, electronic devices.

In another alternate embodiment, the surface panel raised bar may be detachable and movable, where pegs on the surface panel allow for different manual placement of the surface panel raised bar. This feature may also replace some of the functions of the removable plug that holds smaller devices such as, but not limited to, iPods®.

In yet another alternate embodiment, the tray table device may be integrated with an electronic component where the design of a laptop computer could also form a tray table and provide a new functionality of support and use for a person in transit for mobile needs.

In yet other alternate embodiments, various elements may be added to enable the tray table device to achieve more functionality. For example, without limitation, the surface panel and/or the frame may have the capability to contain or hold a power supply or battery that could power other devices in use and conjunction with the tray table device. The tray table device in alternate embodiments may comprise a retractable cup holder or retractable earphones. The tray table device in alternate embodiments may comprise compartments for holding items such as, but not limited to, file folders, DVDs, electronic games, etc.

Having fully described at least one embodiment of the present invention, other equivalent or alternative methods of providing a tray table device according to the present invention will be apparent to those skilled in the art. The invention has been described above by way of illustration, and the specific embodiments disclosed are not intended to limit the invention to the particular forms disclosed. For example, the particular implementation of the mounting clips may vary depending upon the particular type of surface on which the device is to be used. The mounting clips described in the foregoing were directed to implementations to be used on thin surfaces; however, similar techniques are to provide mounting clips to be used on thicker surfaces or adjustable mounting clips. Implementations of the present invention comprising various different types of mounting clips are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding. As such, the numbering and lettering in itself is not intended to and should not be taken to indicate the ordering of elements and/or steps in the claims.

What is claimed is:

1. An apparatus comprising:

means for supporting objects in a first workspace and for supporting devices in a generally upright position;

means for holding said supporting means and for enabling said supporting means to be positioned at a plurality angles;

means for enabling said holding means and said supporting means to be supported a distance above a surface, where said distance is sufficient for enabling a second workspace between said holding means and the surface; and means for mitigating tipping of a beverage can placed between said holding means and the surface.

2. The apparatus as recited in claim 1, further comprising means for removably joining the apparatus to the surface.

3. The apparatus as recited in claim 2, further comprising means for removably locking said joining means during storage.

4. The apparatus as recited in claim 1, further comprising means for mitigating slippage of the objects and devices.

5. The apparatus as recited in claim 1, further comprising means for mitigating slippage of the objects passed a front edge of said supporting means.

6. The apparatus as recited in claim 1, further comprising means for supporting said supporting means in said plurality of angles.

7. The apparatus as recited in claim 1, further comprising means for removably joining items to a bottom side of said holding means.

8. An apparatus comprising:

a surface panel for supporting objects in a first workspace, said surface panel comprising a removable plug having a first flat surface and a second surface comprising rectilinear fingers for supporting devices in a generally upright position;

a frame comprising a top side and a bottom side for holding said surface panel above said top side and for enabling said surface panel to be positioned at a plurality angles relative to said frame;

appendages joined to said frame and deployable from said frame for enabling said frame and said surface panel to be supported a distance above a surface, where said distance is sufficient for enabling a second workspace between said frame and the surface; and at least one soda track joined to said bottom side for mitigating tipping of a beverage can placed between said frame and the surface.

9. The apparatus as recited in claim 8, further comprising mounting clips removably joinable to said appendages for removably joining the apparatus to the surface.

10. The apparatus as recited in claim 9, further comprising mounting locks joined to said bottom side for removably locking said mounting clips during storage.

11. The apparatus as recited in claim 9, wherein said mounting clips further comprise a clip notch for passing a protruding bar on the surface.

12. The apparatus as recited in claim 8, further comprising a surface coating joined to a top surface of said surface panel for mitigating slippage of the objects and devices.

13. The apparatus as recited in claim 12, further comprising rubberized strips joined to said top surface for further mitigating slippage of the objects and devices.

14. The apparatus as recited in claim 8, further comprising a raised bar proximate a front edge of said surface panel for mitigating the slippage of the objects passed said front edge.

15. The apparatus as recited in claim 14, wherein said raised bar is collapsible into said surface panel.

16. The apparatus as recited in claim 8, further comprising a swing arm support rotatably joined to a bottom surface of said surface panel for supporting said surface panel in said plurality of angles.

17. The apparatus as recited in claim 16, wherein said frame further comprises a plurality of stand tracks on said top side for removably locking said swing arm support in said plurality of angles.

18. The apparatus as recited in claim 8, further comprising clasps for removably joining items to said bottom side.

* * * * *